United States Patent [19]

Mertes

[11] 4,061,375

[45] Dec. 6, 1977

[54] MOULDED PLASTIC DRAWER SLIDE

[76] Inventor: Paul M. Mertes, 15528 Don Metz St., Granada Hills, Calif. 91344

[21] Appl. No.: 704,649

[22] Filed: July 12, 1976

Related U.S. Application Data

[63] Continuation-in-part of Ser. No. 576,349, May 12, 1975, abandoned.

[51] Int. Cl.[2] ..... F16C 21/02

[52] U.S. Cl. ..... 308/3.6; 312/348

[58] Field of Search ..... 308/3.6, 3.8, 3 R; 312/346, 347, 342, 341, 345, 348; 74/527

[56] References Cited

U.S. PATENT DOCUMENTS

| | | | |
|---|---|---|---|
| 3,185,530 | 5/1965 | Reiss et al. | 308/3.6 |
| 3,658,394 | 4/1972 | Guntner | 308/3.6 |
| 3,909,078 | 9/1975 | Riley | 312/341 R |
| 3,923,347 | 12/1975 | Dean | 308/3.6 |

*Primary Examiner*—Richard A. Bertsch

*Attorney, Agent, or Firm*—Poms, Smith, Lande & Glenny

[57] ABSTRACT

A universal slide is disclosed herein for mounting on the rear underside of pull drawer for slidably mounting any size drawer on a channel in a cabinet. The slide includes a delta shaped slide or guide member or body having a central strip normally biased downwardly and pointing to the rear and terminating in a beveled hooked end. The underside of the body is provided with downwardly depending guides for slidable engagement with the opposing surfaces of a pair of rails carried by the channel, while the hooked end of the strip extends into the channel between the rails thereof. A stop member is carried on the channel near its outer wall in engageable relationship to the hooked end for positively limiting sliding movement of the body along the channel during the procedure of withdrawing the drawer, with the length of the hook being exposed so that it may be pressed upwardly to release and remove the drawer. The delta shaped body is provided with an upwardly extending rear flange for overlying the rear of the drawer.

12 Claims, 8 Drawing Figures

Fig. 4
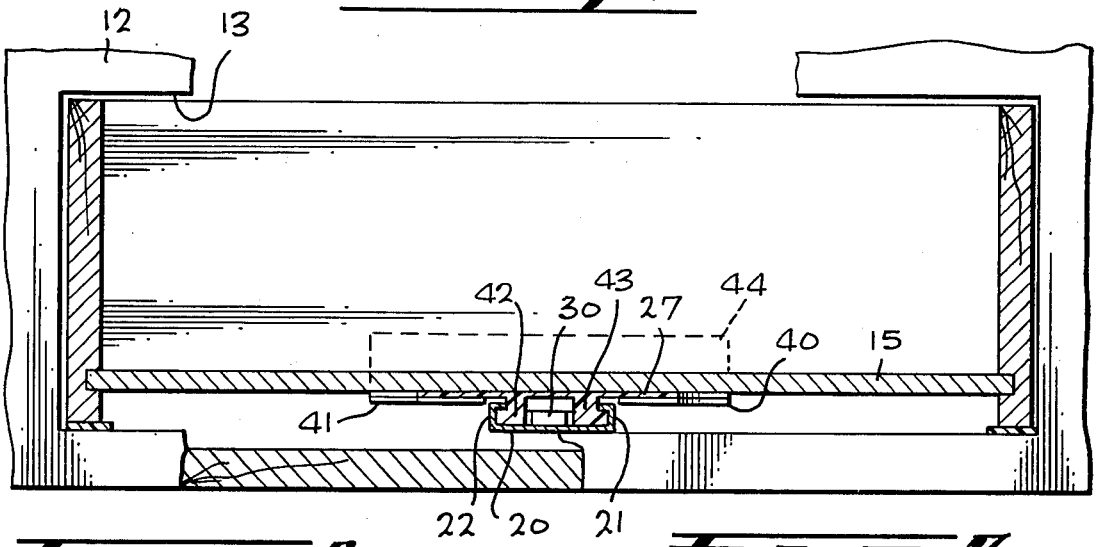
Fig. 5
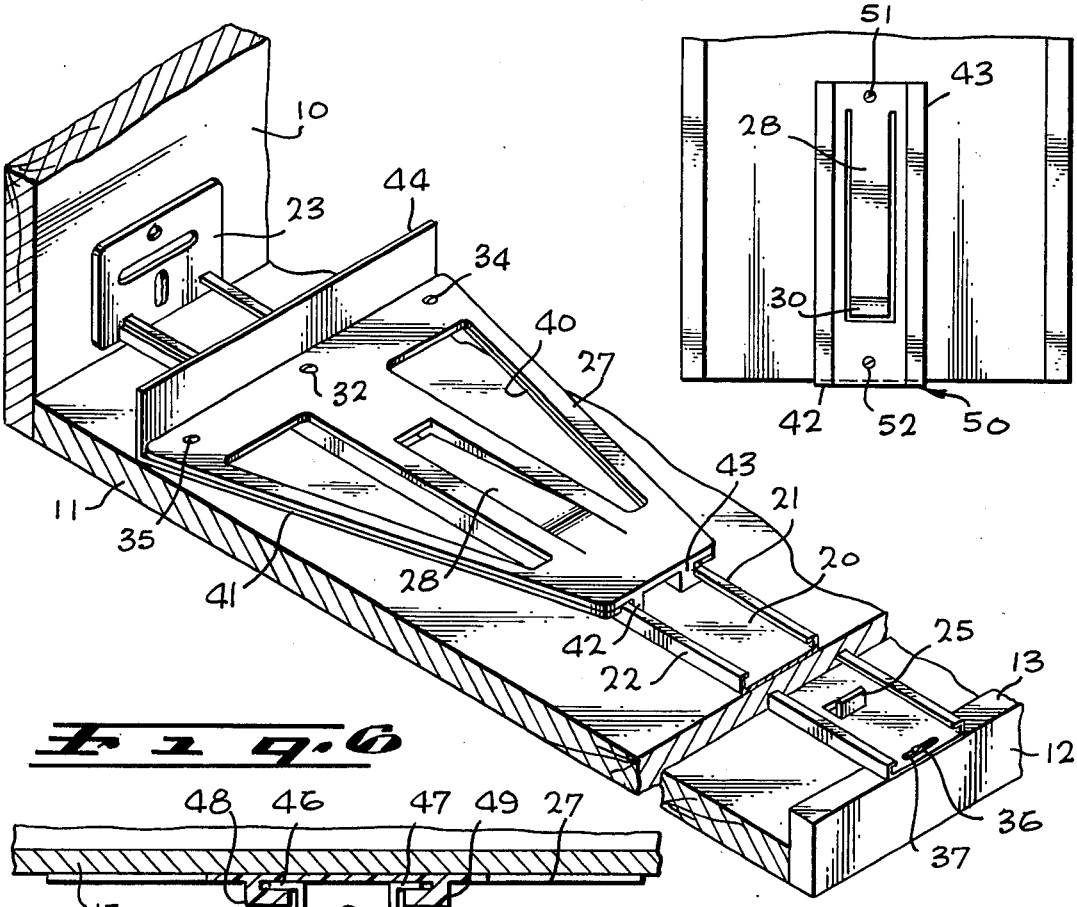
Fig. 7
Fig. 6
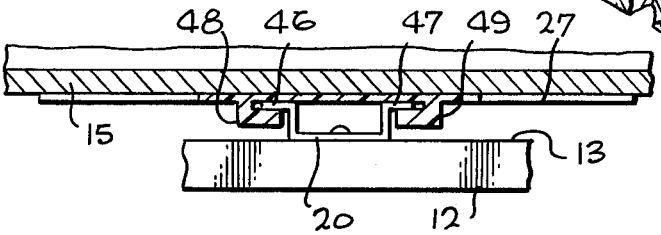
Fig. 8
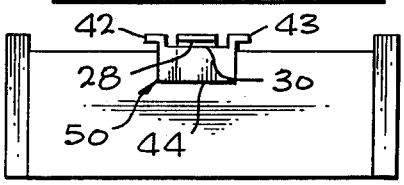

MOULDED PLASTIC DRAWER SLIDE

BACKGROUND OF THE INVENTION

1. Field of the Invention

This invention relates to drawer slides and more particularly to a novel universal drawer slide having lateral control of the slide member and improved support for the drawer.

This application is a continuation-in-part of my prior U.S. patent application Ser. No. 576,349, entitled "Drawer Slide", filed May 12, 1975, abandoned.

2. Brief Description of the Prior Art

In the past, it has been the conventional practice to employ slide members on the underside of a drawer for slideably engaging a channel so that the drawer may be pulled or drawn easily from its storage cavity in a cabinet. Although a variety of slides are known for movably supporting a drawer on a channel, problems have been encountered which stem largely from the fact that the drawer is not supported firmly enough to prevent lateral displacement during movement of the drawer. Also, prior art drawer slides sometimes take the form of a plurality of components which must be carefully installed with respect to alignment and registry between cooperating members. Such a multiplicity of component parts is expensive to manufacture and difficult to assemble or install.

Other known drawer slides extend the full length of the drawer and must be specially made to fit each of the many different drawer lengths.

Therefore, there has been a long standing need to provide a simple universal slide for a drawer whereby the drawer may be readily moved along a track between limit stops and which preclude wobble or lateral misalignment.

SUMMARY OF THE INVENTION

Accordingly, the above problems and difficulties are obviated by the present invention which provides a novel slide for a drawer that includes a slide member having a delta shape with downwardly depending parallel guides for slidably engaging the opposing surfaces of a conventional mounting channel. Disposed between the guides and extending into the channel, there is provided a manually releasable positive stop, in the form of a central strip cantilevered from the slide member toward the rear and which is formed with a hooked end. The central strip is normally biased into the channel so as to positively engage a stop provided at one end of the channel so as to block drawer movement in that direction, as the drawer is slid open. The stop may be released and the drawer removed by manually pressing the hook toward the drawer. The opposite side of the hook may be beveled to ride over the stop as the drawer is inserted.

A rear flange carried by the slide member readily aligns the slide member with the drawer during installation, and may provide additional engagement between the slide and the drawer.

The slide is less than nine inches in length, and preferably less than eight inches long, as compared with the variable normal drawer length of two or three times these lengths. Accordingly, the drawer slide is of universal applicability, which is highly desirable to reduce mould, inventory and other costs in the field.

The width of the guide, in its delta embodiment should be at least two and preferably three inches, at the rear of the drawer to provide lateral stability when it is secured to the drawer only at the rear edge thereof.

Further, the guides of the slide may be held within 0.010 inch tolerances, with the mounting channel having tolerances in the order of 0.001 or 0.002 inch tolerances. Assuming that the drawer is three times the length of the slide, this means that the lateral movement of the drawer is held to about 1/16 of an inch, and normally to less than this figure.

Therefore, it is among the primary object of the present invention to provide a novel slide for a drawer which prevents lateral movement of the drawer during operation.

Another object of the present invention is to provide a novel drawer slide which is light weight and of rigidized construction and which is economic to manufacture and easy to install.

Still a further object of the present invention is to provide a novel drawer slide for slidably mounting a drawer on a channel member, and which includes means cooperating with a limit stop on the channel for limiting the movement of the drawer along the channel.

Still a further object of the present invention is to provide a channel having lateral adjustment means for aligning the drawer with the cabinet opening so that the drawer may ride on the channel without binding against the cabinet in which the drawer is mounted.

In accordance with an important feature of the invention a universal drawer slide is provided, with a single slide fitting all normal drawer sizes from less than one foot to two and one-half feet in depth.

An additional feature of the inventiion is the controlled smooth and effortless drawer action resulting from the small surface area of the short drawer slide in engagement with the mating channel.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings, in which:

FIG. 4 is a transverse cross sectional view of the drawer slide shown in FIG. 3 as taken in the direction of arrows 4—4 thereof;

FIG. 5 is a front perspective view of the drawer slide prior to installation on the bottom of a drawer; and FIG. 6 is a transverse cross sectional view of the novel drawer slide illustrated in another installation version.

FIGS. 7 and 8 are a bottom plan view and an end view respectively of another embodiment of the invention.

DESCRIPTION OF THE PREFERRED EMBODIMENT

Figure 1:
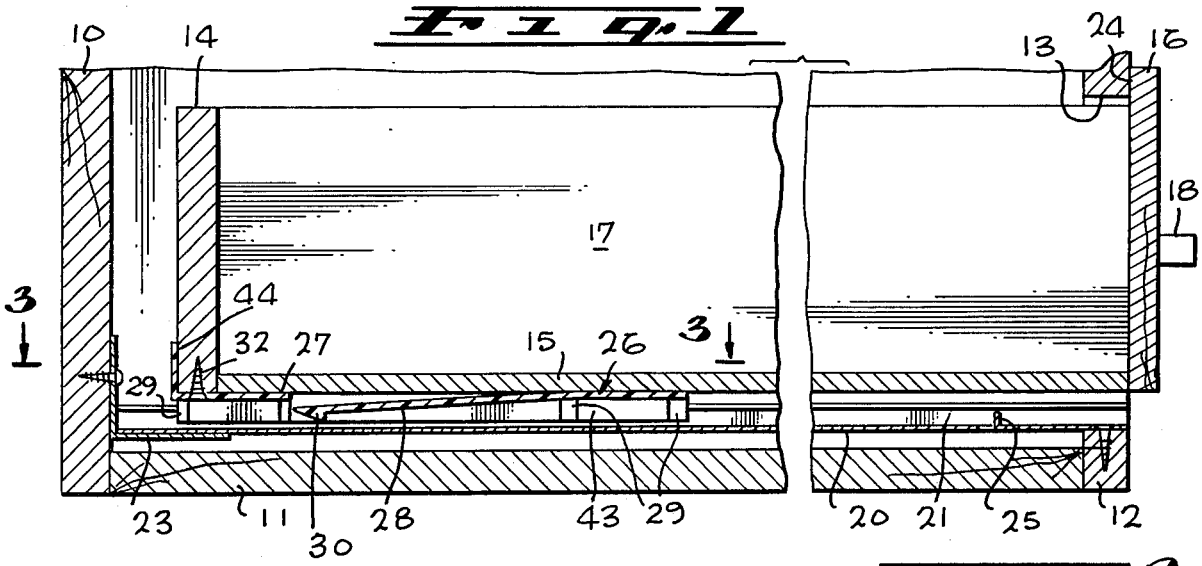
FIG. 1 is a longitudinal cross sectional view of a drawer having a slide of the present invention installed thereon.

Referring to FIG. 1, a conventional cabinet is illustrated which includes, in part, a back 10, a bottom 11 and a front 12. The front 12 is provided with an access opening indicated by numeral 13 into which a conventional drawer is slidably mounted. The drawer includes a back 14, a bottom 15 and a front 16. A pair of sides 17 are also included which extend between the front and back 14 and 16, respectively. A handle 18 is mounted on the front 16 so that the drawer may be manually withdrawn from the cabinet or pushed into the cabinet. As the conventional practice, the cavity in the cabinet occupied by the drawer includes a channel 20 on which the underside of the drawer is slidably mounted. The channel includes a U-shaped member having parallel side rails indicated by numerals 21 and 22 throughout the present specification. The channel 20 further includes a mounting bracket 23 which is carried on one end of the channel member and includes an upright flange that is screwed to the back or rear board of the cabinet 10. The channel 20 further includes limit means for restricting movement of the drawer during withdrawal. For example, the extreme edge 24 of the drawer front 16 limits the rearward movement of the drawer when engaged with the cabinet front 12 while an upright projection 25 limits the forward movement of the drawer.

Figure 2:
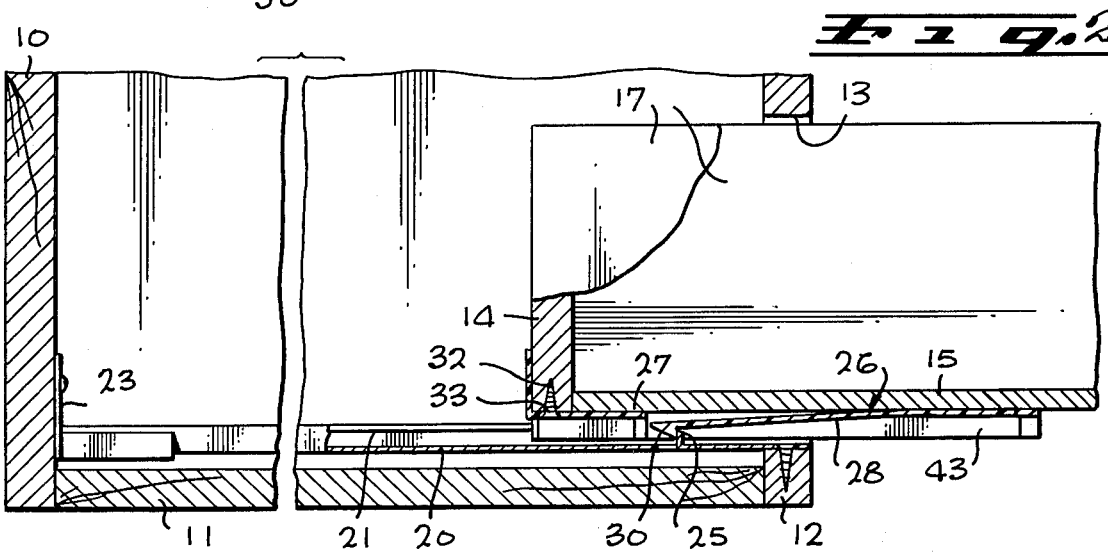
FIG. 2 is a cross sectional view similar to the view of FIG. 1 showing the drawer pulled to its open position.

The drawer slide of the present invention is mounted on the underside of the bottom 15 of the drawer and is indicated in general by the numeral 26. The novel drawer slide 26 includes a body portion or slide member 27 having a central strip 28 which is normally biased downward between the parallel rails of the channel 20. The central strip 28 includes a hooked end 30 which is intended to engage with the upright projection 25, as shown in FIG. 2, to limit movement of the drawer out of the opening 13. The drawer may be easily removed by manually pressing or bending the strip 20 upwardly so as to clear the projection 25. FIG. 2 also illustrates the fact that the slide member 26 is fixedly carried on the underside of bottom 15 of the drawer so that the slide member travels with the drawer. The slide member is attached to the drawer by means of screws such as 34 and 35 at extreme corner of the delta as in FIG. 3 and a central screw 32 as in FIG. 3. Two screws may be fastened into the rear of the drawer back through holes 45 in flange 44 in place of or in addition to central screw 32. The end of the hook facing to the rear is chamfered or bevelled to ride over the stop 25 as the drawer is put back in place after having been removed from the cabinet.

Incidentally, as may be noted in FIGS. 1 and 2, the rails 42 and 43 may be provided with reinforcing ribs 29 at each end of the guide and just before and after the hook 28, 30. These ribs may be triangular or curved from a low elevation at the center to permit passage of the stop 25 to full height adjacent the rails 42, 43 for maximum strength. The ribs 29 are not shown in other figures of the drawings.

Figure 3:
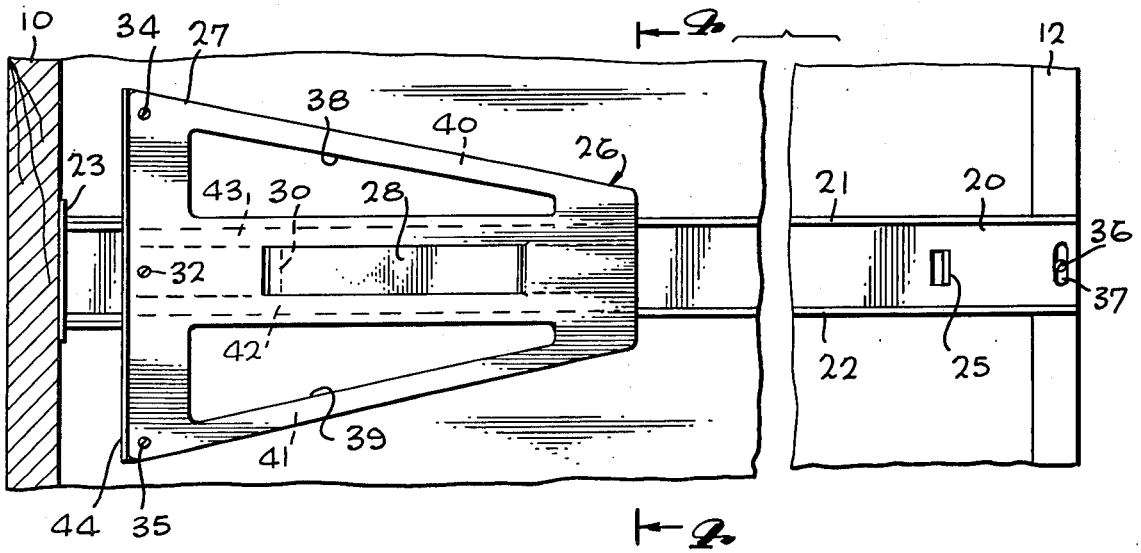
FIG. 3 is a plan view of the novel drawer slide as taken in the direction of arrows 3—3 of FIG. 1.

Referring now in detail to FIG. 3, it can be seen that the slide member 27 is of a delta configuration or shape having its widest portion at the rear of the drawer and its narrowest portion at the front thereof. It can also be seen that the central strip 28 lies on the central longitudinal axis of the slide member and that the strip is in alignment with the channel 20 between its parallel rails 21 and 22. The slide member 27 not only includes a mounting screw 32 which is passed through a hole 33, but includes fastening screws 34 and 35 at opposite sides of the rear of the slide member.

The illustrative delta-shaped slide member shown in the drawings is about 5 ¼ inches in width by seven inches long. More generally, it is contemplated that the slide may be from 4 to 9 inches long, with the preferred range being from 5 to 8 inches; and that it may be from 2 to 7 inches wide with the preferred range being from 2 ½ to 6 inches.

The channel mounting screw 36 extends through an elongated slot 37 to permit lateral channel adjustment to align the drawer precisely in the drawer opening of the cabinet structure. For conservation purposes as well as providing light weight construction, the delta shaped slide member 27 may include cutout portions 38 and 39. However, stiffeners may be provided on the opposite edges of the slide member 27 to rigidize or reinforce the construction and are indentified by numerals 40 and 41 in FIG. 4. If desired, the slide member may be of solid construction without ribs 40 or 41 or cutouts; and the material may be of suitable plastic or other material having a high strength to weight ratio. High density POLYETHELENE may be employed, for example, for its toughness and self lubricating qualities. Other known high strength plastic or other materials may also be employed.

FIG. 4 further illustrates that the slide member 27 includes downwardly depending guides 42 and 43. The downwardly depending guides 42 and 43 are substantially L-shaped in cross section so as to mate with the configuration of the rails 31 and 22 of the channel 20. The guides 42 and 43 engage with the opposing surfaces of the rails 31 and 22 so that the slide member and drawer are in sliding engagement therewith and no lateral movement is permitted. The underside of the slide guides react with the underside of the inwardly directed channel rail feet to prevent the drawer from tipping down when the drawer is pulled fully open. It can also be seen that the hooked end 30 carried on the end of the cantilevered central strip 28 rides in the center of the channel between the guides 42 and 43.

In FIG. 5, the drawer has not been illustrated so that the slide member can be more clearly shown. The slide member 27 is permitted restricted rectilinear movement between the stop member 25 and the stop formed by the engagement of the fronts 16 and 12. The guides 42 and 43 are elongated and readily engage with the opposing surfaces of the rails 21 and 22 of the channel 20 so that adequate support is given for the drawer. To further permit rigidity of construction of the slide member as well as to provide an adequate support, a flange 44 is carried at the rear end of the slide member 27 which can be directly attached to the back 14 of the drawer by screws 45. Such construction further insures proper alignment as a means for squaring-up the slide member in relation to the drawer. The delta slide may be secured to the drawer entirely at the rear edge by fasteners through holes 32, 34 and 35. In addition. fasteners through holes 45 in flange 44 may be used in place of central screw 32 or in addition to screw 32.

Referring now in detail to FIG. 6, another version of the present invention is illustrated wherein the channel 20 is modified to include outwardly extending flanges 46 and 47 rather than the inwardly directed flanges associated with the channel showing in FIGS. 1–5. In this embodiment, the slide member 27 includes guides 48 and 49 which include seats that extend around and beneath the flanges 46 and 47 in sliding engagement therewith.

Therefore, it can be seen that the sliding member of the present invention provides a novel means for slidably mounting a drawer on a channel member. Limit stops are provided which cooperate with the hooked member or end of the central strip 28 so that rearward and forward movement of the drawer is restricted. Rigidity is achieved by means of the stiffeners 41 and 40 as well as by the flange 44. The device is lightened by material removable to provide apertures 38 and 39 and the device is readily installed by screws 32, 34 and 35, respectively. The central strip 28 is cantilevered from the forward end of the slide member rearwardly and is normally biased by its resilient contruction so that the hooked end substantially rides within the channel 20 between the rails 21 and 22. By this construction, the slide member is easy to install and is economic to manufacture.

Another embodiment of the invention is shown in FIGS. 7 and 8. Instead of the delta shape shown in the previous embodiment, a rectangular body or member 50 is used with only a pair of screws 51 and 52 for mounting and stability. A smaller amount of material is used. This version includes a resilient strip 28 with a hooked end 30 and guides 42 and 43 as previously described.

In closing, the present invention will be reviewed and considered in connection with known prior art references. By way of background, prior patents include: R. H. Reiss U.S. Pat. No. 3,185,530, granted May 25, 1965, which shows a complex full length drawer slide which must be moulded for the exact drawer length; C. J. Dean U.S. Pat. No. 3,923,347, granted Dec. 2, 1975, which shows a drawer locking mechanism operative at the rear of a drawer assembly; and K. H. Gutner U.S. Pat. No. 3,658,394, granted Apr. 25, 1972, showing two sheet metal members forming an "overcomeable stop" in a slide assembly extending the full length of a drawer.

In the following paragraphs, some general features, improvements and advantages of the invention will be recapitulated and reviewed in the light of the above prior patents, and commercial drawer construction techniques. Specifically, the system of the invention provides a drawer guide means that substantially eliminates side play and tipping of the drawer in relation to the cabinet or piece of furniture in which it is installed. It permits quick mounting and fastening of the guide to the drawer, and by virtue of its unique shape and self rigidizing structure, allows for very economical manufacturing. It can be readily and reliably moulded from a self lubricating plastic which provides for a smooth and quiet operating function when sliding in a metal channel attached to a cabinet or furniture structure. An integral resilient stop arrangement is provided which is a positive, manually released device, not merely a warning device.

By their very nature, many of the known drawer guide systems do not adequately provide arrangements to eliminate undesirable side play in a drawer unit unless a substantial amount of time is spent in adjusting rollers, or shimming to make a drawer precisely fit the opening. Even then, as the drawer is pulled further from its opening, wobble and side play increase in proportion, or more than proportionately to the withdrawal.

Certain constructional features contributing to the improved results will now be reviewed. The plastic drawer guide is triangular or delta in shape, having two rail members spaced apart and a cantilevered strip with a hooked end between these at its rear or base portion. This is a unique feature of the delta guide, since prior art drawer guide units that claim to prevent side play (such as the Reiss reference) show a drawer member that runs the full length of the drawer and fastens onto the back and the front of the drawer structure. The delta guide may be secured to the drawer only at the drawer back. The two screws at each extreme corner provide a very rigid structure and prevent any lateral movement. The two screws through the flange portion prevent the guide from pulling away from the drawer bottom when the drawers center of gravity falls outside the face of the cabinet and the front wants to come down and the back up, such as in a fully extended position, and these screws are then under shear forces. The guide can also be stapled with an air gun stapler along the rear of the delta guide and in the flange near where the screw holes are shown in FIG. 5, for example.

The guide of the present invention, because of the flange and short length, can be easily squared with the rear of the drawer back, and a centering jig can be used to center it between the drawer sides prior to fastening. In a mass production shop the one location along the back for fastening results in a great savings of labor since the operator is not shifting the staple gun from one area to another. Also, since the delta guide does not fasten to the drawer front as do full length drawer guides, the machining which would be required in some type of drawer construction, to accept the full length drawer guide is eliminated. Some prior art drawer guide systems, such as that shown in the Reiss patent, have used full length guide members on the drawer with fairly loose tolerances between the cabinet member and drawer member for most of the length of the drawer, and have relied on a device at one end of the drawer guide member to have a frictional contact or close contact with the member secured to the cabinet, to eliminate side play. Therefore, as mentioned earlier, the drawer has a fair amount of wobble when extended and only upon closing does it prevent side play.

The delta guide, because of its small size relative to the full length drawer guide, permits the securing of a very accurate part from an injection moulding process. The tolerance between the guide and steel channel that the guide slides in is approximately 0.005 inch. The matching steel guide may be held to about 0.001 inch tolerances. Since the guide is only about 7 inches in length and an average size drawer for a kitchen cabinet is 21 inches, this 0.005 inch will be multiplied about three times to approximately 0.015 inch to 0.018 inch at the drawer front. This provides a drawer with a sufficiently low side play tolerance for the highest quality cabinet and furniture applications and in addition, keeps the drawer tracking straight throughout its length. In view of its small size and weight, the delta guide can be moulded from a thermoplastic material for a fraction of the cost of full length systems. Also, because of its size, it can be moulded to closer tolerances than larger sizes which of necessity must have larger tolerances due to warpage of materials of this type when they are of substantial length (such as the Reiss guide).

An additional advantage is that the delta guide will fit all drawer depths due to the smaller size and the fact that it does not fasten at the front and back of the drawer but only at the back. This results in a great savings in manufacturing and also for the cabinent or furniture manufacturer since he does not have to inventory a multiplicity of different drawer lengths. Particularly for the custom manufacturer who builds cabinets of all depths, all that is necessary is to cut the mating steel channel to the cabinet depth required. In the case of the full length drawer guide of Reiss, for example, if this were attempted on the drawer guide member, some function of the guide would have to be cut off in order for it to fit a shorter drawer. The universal applicability of a single guide becomes particularly important when the several thousand dollar cost of a single injection moulding die is considered. Thus, the savings achieved extend from manufacturing, through inventory and simplified manufacturing operations.

An additional feature of the delta guide, which is an inherent part of its structure is that, when a drawer is picked up at the front, as when the drawer is fully extended, the front of the guide will stay in the channel and allow the drawer bottom to be lifted away from it. The guide possessing enough resiliency in the plastic to be pulled away from the bottom at the front end of the delta guide a considerable distance and still return to a close fit with the bottom with no damage to the guide or excess stress on the fastening means. The drawer however still maintains lateral stability and the drawer can not be untracked from the steel channel and the "moulded in" positive stop. With regard to the stop arrangements shown in the Reiss and Gutner patents, their "stops" are principally warning devices of either a frictional or resilient nature, or a full length guide system which rely on moulded in areas to achieve the same result. They are both devices which can be overcome by a sustained pull, or lifting the front a small amount, and all are marginal as far as a positive stopping is concerned. As an example, a child who is not mindful of the warning device could pull the drawer out, with danger to himself. Also, for recreational vehicles such as mobile homes and campers, the drawers equipped with this invention could not be shaken out of the cabinet by vibration or acceleration while the vehicle is in motion. The stop device does not require any additional cost to manufacture. After the drawer has been removed reinsertion is easy as the cammed end of the cantilevered plastic strip readily overrides the upstanding metal tab in the steel channel. The drawer may be withdrawn at will by merely pressing on the exposed cantilevered strip so that the right angle abutting surface clears the upstanding metal tab. The drawer can then be slid out of the drawer opening without any pulling or lifting up of the drawer front to clear a projection as is required in some prior art arrangements.

An additional feature, contributing to smooth and effortless drawer action, is the small surface area of the guide rails in contact with the slide channel as compared to other full length systems, such as that of Reiss, which use moulded in areas to reduce frictional contact between the cabinet channel and drawer guide.

In conclusion, while particular embodiments of the present invention have been shown and described, it will be obvious to those skilled in the art that changes and modifications may be made without departing from this invention in its broader aspects, and therefore, the aim in the appended claims is to cover all such changes and modifications as fall within the true spirit and scope of this invention.

I claim:

1. A universal drawer slide to be secured to the rear bottom of a drawer to engage a matching track, said drawer slide comprising:

a delta shaped moulded plastic body member;

two downwardly depending guides each being of generally L-shaped cross section, for engaging a matching track, extending substantially the length of said member;

an upwardly directed flange for overlying the rear end of a drawer;

said delta shaped body member having its widest portion at the rear of the drawer and its narrowest portion towards the front thereof, and said widest portion extending a substantial distance on either side of said downwardly depending guides; and an integrally moulded hook formed of a length of plastic mounted between said two guides and resiliently pivotted to extend toward said flange, said hook extending down from said body member and having a beveled surface facing toward said flange to slide over a stop as the drawer is being mounted, and further including means opposite said bevel for positively engaging said a stop, subject however to release by pressure applied to the exposed length of the hook to raise said engaging means over said stop.

2. A universal drawer slide as set forth in claim 1 wherein said guides are held to tolerances of less than 0.010 inch, whereby a normal drawer with which the guide would be used, will have side play of less than 1/16 inch.

3. A universal drawer slide as set forth in claim 1 wherein said slide is an integral injection moulded part formed of high strength self lubricating plastic material, and wherein said slide is less than eight inches in length and more than three inches in width adjacent said flange.

4. A universal drawer slide as set forth in claim 1 wherein means are provided only on said flange and at the rear edge of said body member adjacent said flange for securing said slide to a drawer, whereby said slide prevents side play even if a drawer is raised as it is opened.

5. A drawer and universal slide assembly comprising:

a drawer having a predetermined length;

a high strength plastic slide body having a length less than one-half of the length of said drawer secured to the bottom rear of said drawer;

two parallel guides integral with said slide body and extending downwardly and away from the centerline of said slide body, said guides running for substantially the entire length of said slide body;

a fixed channel member extending for substantially the length of said drawer when the drawer is in the closed position, said channel member carrying two rails making a close freely sliding fit above and below said guides for substantially the entire length of said guides;

a stop member extending up between said rails near the outer end of said channel; and means, including an extended resilient hook member formed integral with said slide and extending toward the rear, for providing a manually releasable positive stop preventing said drawer from being inadvertently removed; said hook member extending down between said guides and said rails to positively engage said stop member when the length of said resilient hook is exposed in front of said channel to receive manual hook releasing pressure.

6. A drawer and universal slide assembly as defined in claim 5 wherein said hook member is provided with a bevelled surface facing toward the rear of the drawer for riding over said stop when the drawer is being mounting into position.

7. A drawer and universal slide assembly as defined in claim 5 wherein said guides are held to lateral tolerances of less than 0.010 inch and said rails are held to lateral tolerances of less than 0.002 inch, whereby side play of the drawer is less than 1/16 inch.

8. A drawer and universal slide assembly as defined in claim 5 wherein said channel member is provided with laterally adjustable front securing means for holding the front end of said channel in position and centering the drawer in the drawer opening.

9. A drawer and universal slide assembly as defined in claim 5 wherein said slide body is generally triangular in shape, and where means are provided for securing said slide body to the drawer only at the rear of said drawer and out of the rear edge of said slide body, whereby the front part of said slide body may separate slightly from engagement with said drawer body and still prevent side play when the drawer is raised as it is pulled forward.

10. A drawer and universal slide assembly as defined in claim 5 wherein said universal slide is an injection moulded part formed of high strength self lubricating plastic material.

11. A universal slide device for a pull-out drawer comprising the combination of:

a channel section having a forward and a rearward stop means;

a drawer having a bottom supporting a continuous sidewall therearound;

a slide member carried on the underside of said drawer bottom;

said slide member having guide means downwardly depending therefrom in slidable engagement with said channel;

said slide member being further provided with a cantilevered central strip normally biased towards said channel and said strip having a downwardly depending hooked end for engaging with said channel forward stop means to restrict forward movement of said drawer; and an attachment device for solely securing said slide member to said drawer comprising an upright flange carried at the rear of said slide member for securing against the rear wall of said drawer to solely support and secure said slide member with respect to said drawer;

said slide member is delta shaped in plan view and is of a definite length shorter than the length of said drawer;

said guide means includes a pair of elongated, spaced apart ribs separated by said central strip and further includes feet members cooperating with said channel rails to slide said slide member thereon;

said slide member is composed of a material chosen from a selection of high strength-to-weight ratio materials; and attachment screws are provided for securing said slide member to said drawer wherein said screws extend through the rear edge marginal region of said slide member flange into securement with said drawer.

12. A slide device as set forth in claim 11, wherein said delta shaped slide member includes cut-out apertures on either side of said central strip; and wherein said slide member further includes a pair of reinforcement ribs downwardly depending from the opposite edges of said slide member for rigidizing the device.

* * * * *